US010950095B2

(12) United States Patent
Hufnagl-Abraham

(10) Patent No.: US 10,950,095 B2
(45) Date of Patent: Mar. 16, 2021

(54) PROVIDING MIXED REALITY SPORTING EVENT WAGERING, AND RELATED SYSTEMS, METHODS, AND DEVICES

(71) Applicant: IGT, Las Vegas, NV (US)

(72) Inventor: Klaus Hufnagl-Abraham, Graz (AT)

(73) Assignee: IGT, Las Vegas, NV (US)

( * ) Notice: Subject to any disclaimer, the term of this patent is extended or adjusted under 35 U.S.C. 154(b) by 48 days.

(21) Appl. No.: 16/276,233

(22) Filed: Feb. 14, 2019

(65) Prior Publication Data

US 2020/0265684 A1 Aug. 20, 2020

(51) Int. Cl.
*G07F 17/32* (2006.01)

(52) U.S. Cl.
CPC ..... *G07F 17/3288* (2013.01); *G07F 17/3211* (2013.01); *G07F 17/3225* (2013.01); *G07F 17/3244* (2013.01); *G07F 17/3206* (2013.01)

(58) Field of Classification Search
CPC ..... G07F 17/3211; G07F 17/3225; G07F 17/3288; G07F 17/3244; G07F 17/3206
See application file for complete search history.

(56) References Cited

U.S. PATENT DOCUMENTS 9,659,447 B2 * 5/2017 Lyons ..... G07F 17/3244
9,679,437 B2 * 6/2017 Detlefsen ..... G07F 17/3225
10,129,569 B2 * 11/2018 Ortiz ..... H04N 21/25816
10,204,471 B2 * 2/2019 Lyons ..... G07F 17/3225
10,417,872 B2 * 9/2019 Heathcote ..... G07F 17/3227
10,643,433 B2 * 5/2020 Pilnock ..... G07F 17/3288
10,755,528 B2 * 8/2020 Pilnock ..... G07F 17/3241
2012/0184352 A1 * 7/2012 Detlefsen ..... G07F 17/3225 463/25
2012/0274775 A1 * 11/2012 Reiffel ..... G06Q 30/08 348/158
2013/0273994 A1 * 10/2013 Cobb ..... A63F 13/828 463/18
2015/0287265 A1 * 10/2015 Lyons ..... G07F 17/3206 463/25
2017/0193708 A1 * 7/2017 Lyons ..... A63F 13/87
2017/0236364 A1 * 8/2017 Heathcote ..... G07F 17/3227 463/20
2018/0089935 A1 * 3/2018 Froy, Jr. ..... G07F 17/3209
2018/0122179 A1 5/2018 Lyons et al.
2018/0316947 A1 11/2018 Todd
2020/0242895 A1 * 7/2020 Nelson ..... G07F 17/3211
2020/0265684 A1 * 8/2020 Hufnagl-Abraham ..... G07F 17/3211

(Continued)

*Primary Examiner* — William H McCulloch, Jr.
(74) *Attorney, Agent, or Firm* — Sage Patent Group

(57) ABSTRACT

An image capture device, which may be part of or associated with a mixed reality viewer device, may capture image data representative of an image of a live sporting event, and the live sporting event may be identified based on the image data. Player status data indicative of a player status of a player using a gaming device, such as the mixed reality viewer device, may be retrieved from a player database, and the player status of the player may be determined based on the player status data. Based on identifying the live sporting event and determining the player status, a wager associated with the live sporting event may be selected and an indication of the wager provided to a display device that is viewable by the player. In response to receiving acceptance data indicative of the player accepting the wager, the wager may be resolved.

20 Claims, 9 Drawing Sheets

(56) References Cited

U.S. PATENT DOCUMENTS

| | | | | |
|---|---|---|---|---|
| 2020/0334954 | A1* | 10/2020 | Nelson | G07F 17/3262 |
| 2020/0334959 | A1* | 10/2020 | Nelson | G06Q 50/34 |
| 2020/0342717 | A1* | 10/2020 | Nelson | G07F 17/3288 |

* cited by examiner

PROVIDING MIXED REALITY SPORTING EVENT WAGERING, AND RELATED SYSTEMS, METHODS, AND DEVICES

BACKGROUND

Embodiments relate to sporting event wagering, and in particular to providing mixed reality sporting event wagering, and related systems, methods, and devices. Competitive sporting events have many aspects that make them attractive to spectators, both from an entertainment standpoint and a wagering and/or betting standpoint. Live sporting events may be viewed in person, e.g., in a sports venue such as a stadium or arena, or remotely, e.g., in a casino or other environment, via a television or other video display. As technology improves and as the competition for the attention of bettors and spectators increases, there is a need for additional interactive features that increase spectator involvement and excitement.

SUMMARY

According to an embodiment, a gaming system includes a processor circuit and a memory coupled to the processor circuit. The memory includes machine-readable instructions that, when executed by the processor circuit, cause the processor circuit to cause an image capture device to capture image data representative of an image of a live sporting event. The machine-readable instructions further cause the processor circuit to identify the live sporting event based on the image data. The machine-readable instructions further cause the processor circuit to retrieve player status data indicative of a player status of a player using a gaming device from a player database. The machine-readable instructions further cause the processor circuit to determine the player status of the player based on the player status data. The machine-readable instructions further cause the processor circuit to select, based on identifying the live sporting event and determining the player status, a wager of a plurality of wagers associated with the live sporting event. The machine-readable instructions further cause the processor circuit to provide an indication of the wager to a display device that is viewable by the player. The machine-readable instructions further cause the processor circuit to, in response to receiving acceptance data indicative of the player accepting the wager, resolve the wager.

According to another embodiment, a computer-implemented method includes, based on image data representative of an image of a live sporting event captured by an image capture device, identifying the live sporting event. The computer-implemented method further includes determining a player status of a player using a gaming device based on player status data indicative of the player status retrieved from a player database. The computer-implemented method further includes selecting, based on identifying the live sporting event and determining the player status, a wager of a plurality of wagers associated with the live sporting event. The computer-implemented method further includes causing the wager to be displayed to a display device that is viewable by the player. The computer-implemented method further includes, in response to receiving acceptance data indicative of the player accepting the wager, causing the wager to be resolved.

According to another embodiment, a gaming device includes an image capture device, a display device, an input device, a processor circuit, and a memory coupled to the processor circuit. The memory includes machine-readable instructions that, when executed by the processor circuit, cause the processor circuit to cause the image capture device to capture image data representative of an image of a live sporting event. The machine-readable instructions further cause the processor circuit to identify the live sporting event based on the image data. The machine-readable instructions further cause the processor circuit to retrieve player status data indicative of a player status of a player using the gaming device from a player database. The machine-readable instructions further cause the processor circuit to determine the player status of the player based on the player status data. The machine-readable instructions further cause the processor circuit to select, based on identifying the live sporting event and determining the player status, a wager of a plurality of wagers associated with the live sporting event. The machine-readable instructions further cause the processor circuit to provide an indication of the wager to the display device. The machine-readable instructions further cause the processor circuit to, in response to receiving acceptance data from the input device indicative of the player accepting the wager, transmit an instruction to resolve the wager to a gaming server.

DETAILED DESCRIPTION

Embodiments relate to sporting event wagering, and in particular to providing mixed reality sporting event wagering, and related systems, methods, and devices. In some embodiments, an image capture device, which may be part of or associated with a mixed reality viewer device, may capture image data representative of an image of a live sporting event, and the live sporting event may be identified based on the image data. Player status data indicative of a player status of a player using a gaming device, such as the mixed reality viewer device, may be retrieved from a player database, and the player status of the player may be determined based on the player status data. Based on identifying the live sporting event and determining the player status, a wager associated with the live sporting event may be selected and an indication of the wager provided to a display device that is viewable by the player, e.g., through the mixed reality viewer device, for example. In response to receiving acceptance data indicative of the player accepting the wager, the wager may be resolved.

Figure 1:
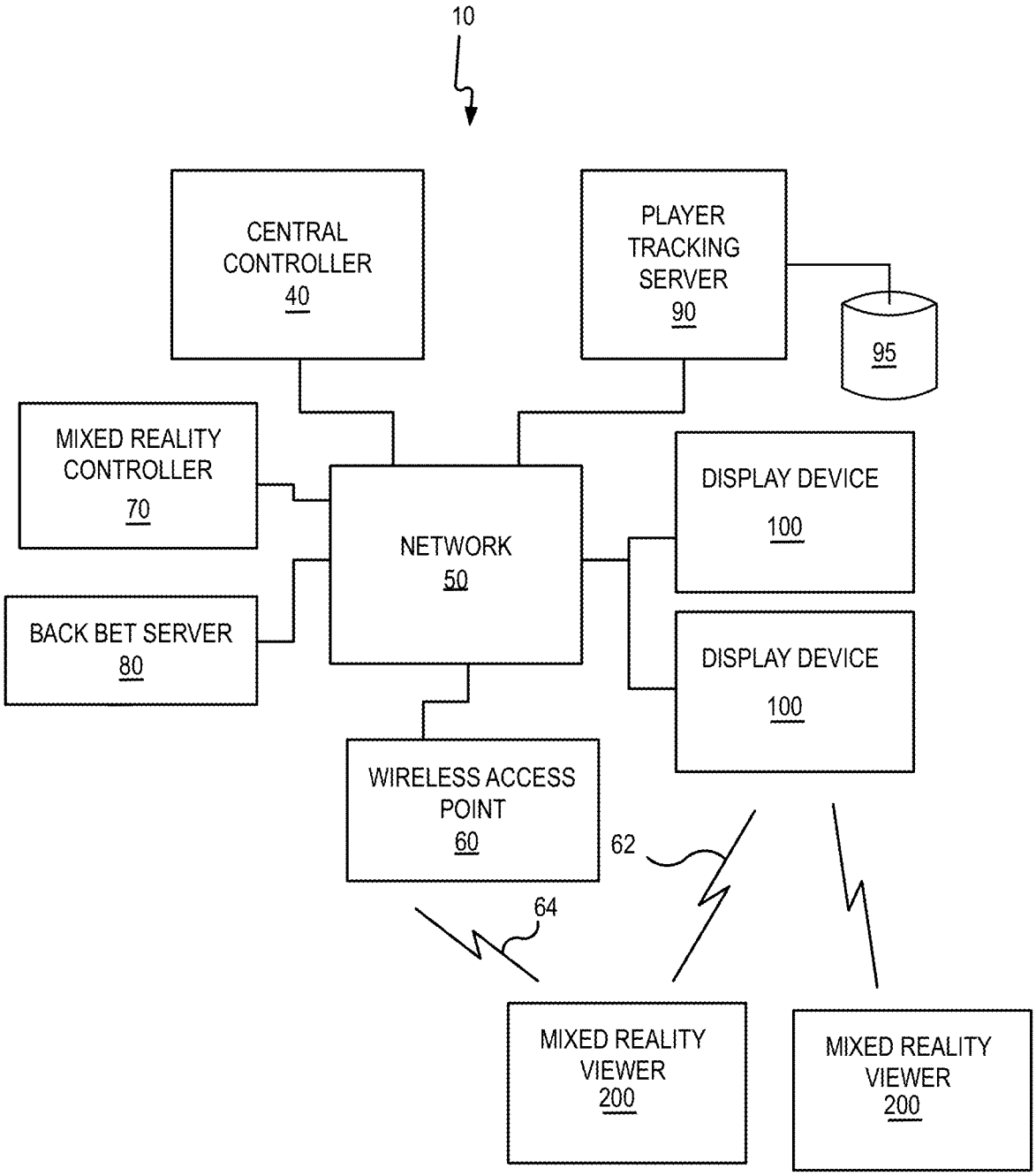
FIG. 1 is a schematic block diagram illustrating a network configuration for a plurality of gaming devices according to some embodiments.

Before discussing aspects of the embodiments disclosed herein, reference is made to FIG. 1, which illustrates a networked gaming system 10 that includes a plurality of displays 100 and mixed reality viewers 200. The gaming system 10 may be located, for example, on the premises of a gaming establishment, such as a casino. The displays 100, which may be situated in a casino sports and racing book or elsewhere on a casino floor, may be in communication with each other and/or at least one central controller 40 through a data network or remote communication link 50. The data communication network 50 may be a private data communication network that is operated, for example, by the gaming facility that operates the displays 100. Communications over the data communication network 50 may be encrypted for security. The central controller 40 may be any suitable server or computing device which includes at least one processor and at least one memory or storage device. Each display 100 may be a passive display, or may be a smart display that includes a processor that transmits and receives events, messages, commands or any other suitable data or signal between the displays 100 and the central controller 40. The display processor is operable to execute such communicated events, messages or commands in conjunction with the operation of the display 100. In some examples, the display 100 may be a standalone device, or may be part of another device, such as a gaming device that provides wagering opportunities (e.g., sports betting, slot play, etc.) through the display 100 or through another display associated with the device. Moreover, the processor of the central controller 40 is configured to transmit and receive events, messages, commands or any other suitable data or signal between the central controller 40 and each of the individual displays 100. In some embodiments, one or more of the functions of the central controller 40 may be performed by one or more display processors. Moreover, in some embodiments, one or more of the functions of one or more display processors as disclosed herein may be performed by the central controller 40.

A wireless access point 60 provides wireless access to the data communication network 50. The wireless access point 60 may be connected to the data communication network 50 as illustrated in FIG. 1, or may be connected directly to the central controller 40 or another server connected to the data communication network 50.

A player tracking server 90 may also be connected through the data communication network 50. The player tracking server 90 may manage a player tracking account that tracks the player's gameplay and spending and/or other player preferences and customizations, manages loyalty awards for the player, manages funds deposited or advanced on behalf of the player, and other functions. Player information managed by the player tracking server 90 may be stored in a player information database 95.

As further illustrated in FIG. 1, a mixed reality viewer 200, or augmented reality (AR) viewer 200, is provided. The mixed reality viewer 200 communicates with one or more elements of the system 10 to render two-dimensional (2D) and/or three-dimensional (3D) content to a user, e.g., a casino operations worker, in a virtual space, while at the same time allowing the casino operations worker to see objects in the real space around the user, e.g., on the casino floor. That is, the mixed reality viewer 200 combines a virtual image with real images perceived by the user, including images of real objects. In this manner, the mixed reality viewer 200 "mixes" real and virtual reality into a single viewing experience for the user. In some embodiments, the mixed reality viewer 200 may be further configured to enable the user to interact with both the real and virtual objects displayed to the player by the mixed reality viewer 200. In some embodiments, the mixed reality viewer 200 may be replaced with a virtual reality (VR) viewer that combines a video signal of a real event with virtual reality elements to generate a single mixed reality viewing experience via a VR display.

The mixed reality viewer 200 communicates with one or more elements of the system 10 to coordinate the rendering of mixed reality images, and in some embodiments mixed reality 3D images, to the user. For example, in some embodiments, the mixed reality viewer 200 may communicate directly with a display 100 over a wireless interface 62, which may be a Wi-Fi link, a Bluetooth link, an NFC link, etc. In other embodiments, the mixed reality viewer 200 may communicate with the data communication network 50 (and devices connected thereto, including displays) over a wireless interface 64 with the wireless access point 60. The wireless interface 64 may include a Wi-Fi link, a Bluetooth link, an NFC link, etc. In still further embodiments, the mixed reality viewer 200 may communicate simultaneously with both the display 100 over the wireless interface 62 and the wireless access point 60 over the wireless interface 64. In these embodiments, the wireless interface 62 and the wireless interface 64 may use different communication protocols and/or different communication resources, such as different frequencies, time slots, spreading codes, etc. For example, in some embodiments, the wireless interface 62 may be a Bluetooth link, while the wireless interface 64 may be a Wi-Fi link.

The wireless interfaces 62, 64 allow the mixed reality viewer 200 to coordinate the generation and rendering of mixed reality images to the user via the mixed reality viewer 200.

In some embodiments, the gaming system 10 includes a mixed reality controller, or mixed reality controller 70. The mixed reality controller 70 may be a computing system that communicates through the data communication network 50 with the displays 100 and the mixed reality viewers 200 to coordinate the generation and rendering of virtual images to one or more users using the mixed reality viewers 200. The mixed reality controller 70 may be implemented within or separately from the central controller 40.

In some embodiments, the mixed reality controller 70 may coordinate the generation and display of the virtual images of the same virtual object to more than one user by more than one mixed reality viewer 200. As described in more detail below, this may enable multiple users to interact with the same virtual object together in real time. This feature can be used to provide a shared experience to multiple users at the same time.

The mixed reality controller 70 may store a three-dimensional wireframe map of a gaming area, such as a casino floor, and may provide the three-dimensional wireframe map to the mixed reality viewers 200. The wireframe map may store various information about displays and other games or locations in the gaming area, such as the identity, type and location of various types of displays, games, etc. The three-dimensional wireframe map may enable a mixed reality viewer 200 to more quickly and accurately determine its position and/or orientation within the gaming area, and also may enable the mixed reality viewer 200 to assist the user in navigating the gaming area while using the mixed reality viewer 200.

In some embodiments, at least some processing of virtual images and/or objects that are rendered by the mixed reality viewers 200 may be performed by the mixed reality controller 70, thereby offloading at least some processing requirements from the mixed reality viewers 200. The mixed reality viewer may also be able to communicate with other aspects of the gaming system 10, such as a back bet server 80 or other device through the network 50.

Referring to FIGS. 2A to 2E, the mixed reality viewer 200 may be implemented in a number of different ways. For example, referring to FIG. 2A. in some embodiments, a mixed reality viewer 200A may be implemented as a 3D headset including a pair of semitransparent lenses 212 on which images of virtual objects may be displayed. Different stereoscopic images may be displayed on the lenses 212 to create an appearance of depth, while the semitransparent nature of the lenses 212 allow the user to see both the real world as well as the 3D image rendered on the lenses 212. The mixed reality viewer 200A may be implemented, for example, using a Hololens™ from Microsoft Corporation. The Microsoft Hololens includes a plurality of cameras and other sensors that the device uses to build a 3D model of the space around the user. The device 200A can generate a 3D image to display to the user that takes into account the real-world objects around the user and allows the user to interact with the 3D object.

The device 200A may further include other sensors, such as a gyroscopic sensor, a GPS sensor, one or more accelerometers, and/or other sensors that allow the device 200A to determine its position and orientation in space. In further embodiments, the device 200A may include one or more cameras that allow the device 200A to determine its position and/or orientation in space using visual simultaneous localization and mapping (VSLAM). The device 200A may further include one or more microphones and/or speakers that allow the user to interact audially with the device.

Figure 2A:
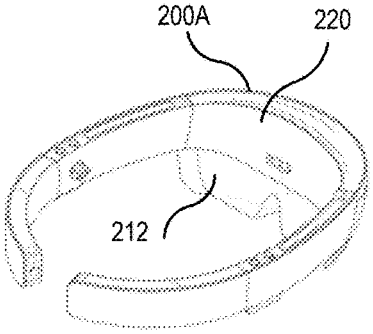
FIGS. 2A to 2E illustrate mixed reality viewer devices and gaming devices according to various embodiments.
Figure 2B:
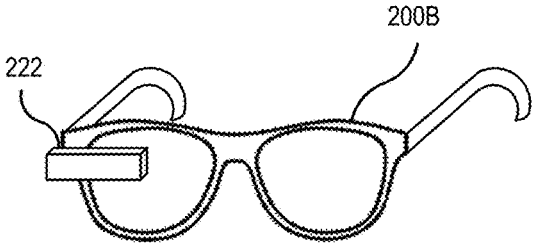

Referring to FIG. 2B, a mixed reality viewer 200B may be implemented as a pair of glasses 200B including a transparent prismatic display 222 that displays an image to a single eye of the user. An example of such a device is the Google Glass device. Such a device may be capable of displaying images to the user while allowing the user to see the world around the user, and as such can be used as a mixed reality viewer.

Figure 2C:
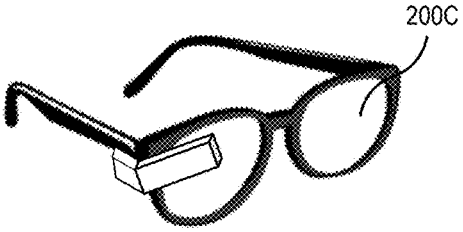
Figure 2D:
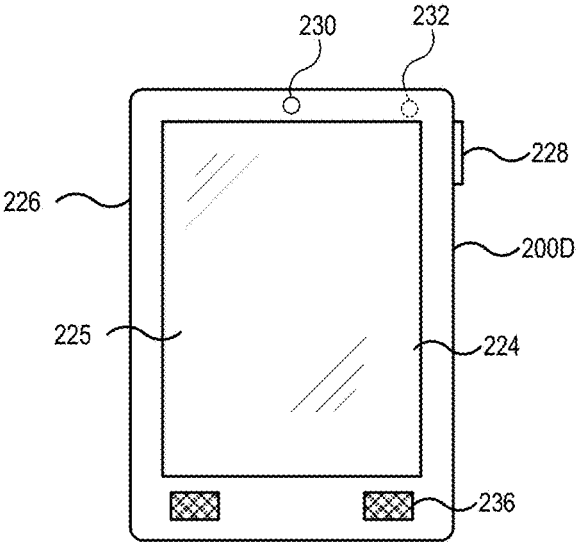

In other embodiments, referring to FIG. 2C, the mixed reality viewer may be implemented using a virtual retinal display device 200C. In contrast to devices that display an image within the field of view of the user, a virtual retinal display raster scans an image directly onto the retina of the user. Like the device 200B, the virtual retinal display device 200C combines the displayed image with surrounding light to allow the user to see both the real world and the displayed image.

In still further embodiments, a mixed reality viewer 200D may be implemented using a mobile wireless device, such as a mobile telephone, a tablet computing device, a personal digital assistant, or the like. The device 200D may be a handheld device including a housing 226 on which a touchscreen display device 224 including a digitizer 225 is provided. An input button 228 may be provided on the housing and may act as a power or control button. A front facing camera 230 may be provided in a front face of the housing 226. The device 200D may further include a rear facing camera 232 on a rear face of the housing 226. The device 200D may include one or more speakers 236 and a microphone. The device 200D may provide a mixed reality display by capturing a video signal using the rear facing camera 230 and displaying the video signal on the display device 224, and also displaying a rendered image of a virtual object over the captured video signal. In this manner, the user may see both a mixed image of both a real object in front of the device 200D as well as a virtual object superimposed over the real object to provide a mixed reality viewing experience.

Figure 2E:
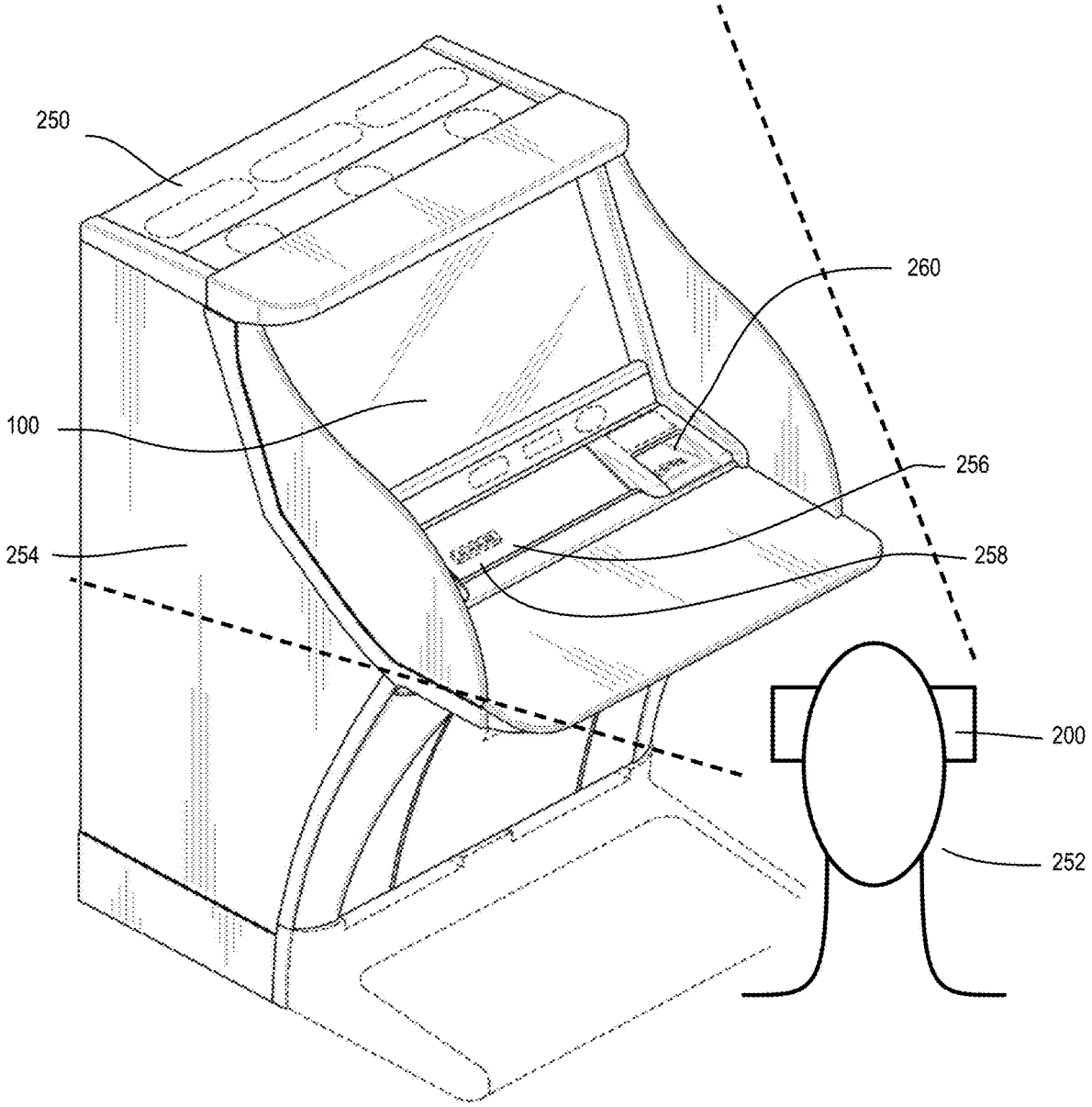

Referring now to FIG. 2E, a gaming device 250 may include a display 100 for providing video content, gaming content, or other content to a user 252 wearing a mixed reality device 200. In this example, gaming device 250 is an electronic gaming machine (EGM), which may be located in a casino environment, or other suitable location. In this example, the gaming device 250 includes a housing 254 and a plurality of input devices 256, such as a keypad or buttons 258, etc., for receiving user input for playing the wagering game and otherwise interacting with the gaming device 250. In some embodiments, the display device 100 may include a touchscreen interface for receiving user input as well. The display device 100 may also be a single display device or may include multiple display devices, such as a first display device for displaying video content and a second display device for displaying gaming and wagering information for example. The gaming device 250 may include additional specialized hardware as well, such as an acceptor/dispenser 260, for receiving items such as currency (i.e., bills and/or coins), tokens, credit or debit cards, or other physical items associated with monetary or other value, and/or for dispensing items, such as physical items having monetary or other value (e.g., awards or prizes) or other items. It should also be understood that in some embodiments, the gaming device 250 may include an acceptor and/or a dispenser as separate components. The mixed reality device 200 may communicate with the gaming device 250 to coordinate display of different video, gaming, and/or virtual elements to the user 252, or may operate independently of the gaming device 250, as desired.

Figure 3A:
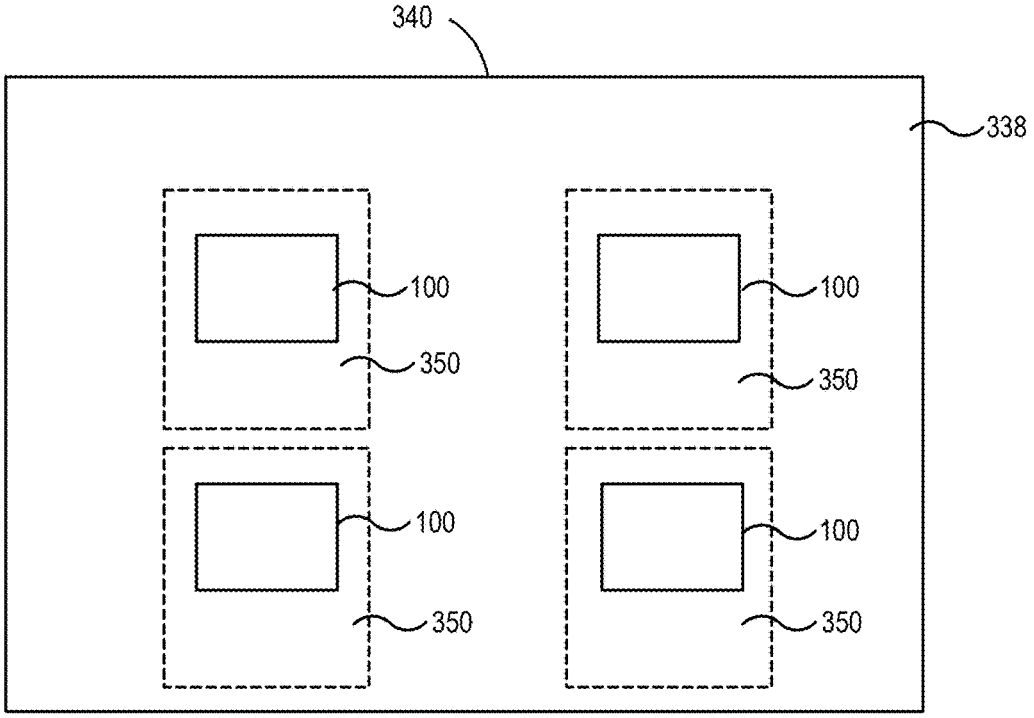
FIG. 3A is a map of a gaming area, such as a casino floor.

Referring now to FIG. 3A, an example map 338 of a gaming area 340 is illustrated in plan view. The gaming area 340 may, for example, be a casino floor. The map 338 shows the location of a plurality of displays 100 within the gaming area 340. As will be appreciated, the locations of the displays 100 and other games and objects (not shown) within a gaming area 340 are generally fixed, although a casino operator may relocate displays from time to time, within the gaming area 340. As noted above, in order to assist the operation of the mixed reality viewers (such as mixed reality viewers 200), the mixed reality controller 70 of FIG. 1 may store a three-dimensional wireframe map of the gaming area 340, and may provide the three-dimensional wireframe map to the mixed reality viewers.

Figure 3B:
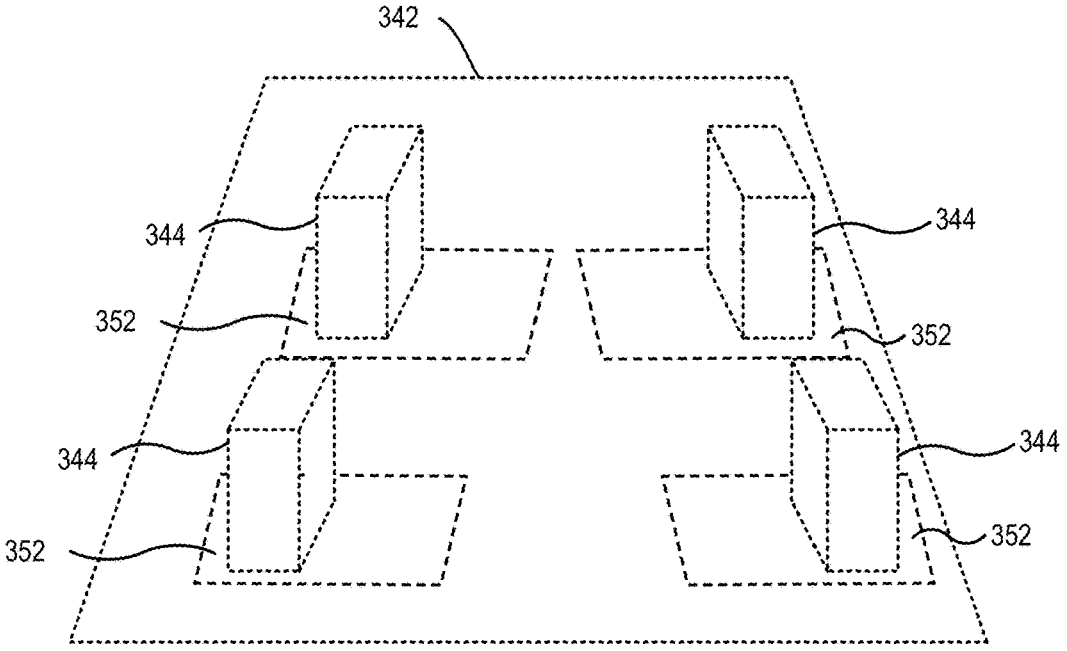
FIG. 3B is a 3D wireframe model of the gaming area of FIG. 3A.

An example of a wireframe map 342 is shown in FIG. 3B. The wireframe map is a three-dimensional model of the gaming area 340, such as a race and sports book, for example. As shown in FIG. 3B, the wireframe map 342 includes wireframe models 344 corresponding to the displays 100 that are physically in the gaming area 340. The wireframe models 344 may be pregenerated to correspond to various display form factors and sizes. The pregenerated models may then be placed into the wireframe map, for example, by a designer or other personnel. The wireframe map 342 may be updated whenever the physical location of displays in the gaming area 340 is changed.

In some embodiments, the wireframe map 342 may be generated automatically using a mixed reality viewer, such as a 3D headset, that is configured to perform a three-dimensional depth scan of its surroundings and generate a three-dimensional model based on the scan results. Thus, for example, an operator using a mixed reality viewer 200A (FIG. 2A) may perform a walkthrough of the gaming area 340 while the mixed reality viewer 200A builds the 3D map of the gaming area.

The three-dimensional wireframe map 342 may enable a mixed reality viewer to more quickly and accurately determine its position and/or orientation within the gaming area. For example, a mixed reality viewer may determine its location within the gaming area 340 using one or more position/orientation sensors. The mixed reality viewer then builds a three-dimensional map of its surroundings using depth scanning, and compares its sensed location relative to objects within the generated three-dimensional map with an expected location based on the location of corresponding objects within the wireframe map 342. The mixed reality viewer may calibrate or refine its position/orientation determination by comparing the sensed position of objects with the expected position of objects based on the wireframe map 342. Moreover, because the mixed reality viewer may have access to the wireframe map 342 of the entire gaming area 340, the mixed reality viewer can be aware of objects or destinations within the gaming area 340 that it has not itself scanned. Processing requirements on the mixed reality viewer may also be reduced because the wireframe map 342 is already available to the mixed reality viewer.

In some embodiments, the wireframe map 342 may store various information about displays or other games and locations in the gaming area, such as the identity, type, orientation and location of various types of displays, the locations of exits, bathrooms, courtesy desks, cashiers, ATMs, ticket redemption machines, etc. Additional information may include a predetermined region 350 around each display 100, which may be represented in the wireframe pap 342 as wireframe models 352. Such information may be used by a mixed reality viewer to help the user navigate the gaming area. For example, if a user desires to find a destination within the gaming area, the user may ask the mixed reality viewer for directions using a built-in microphone and voice recognition function in the mixed reality viewer or use other hand gestures or eye/gaze controls tracked by the mixed reality viewer (instead of or in addition to voice control). The mixed reality viewer may process the request to identify the destination, and then may display a virtual object, such as a virtual path on the ground, virtual arrow, virtual sign, etc., to help the user to find the destination. In some embodiments, for example, the mixed reality viewer may display a halo or glow around the destination to highlight it for the user, or have virtual 3D sounds coming from it so users could more easily find the desired location.

According to some embodiments, a user of a mixed reality viewer may use the mixed reality viewer to obtain information about players and/or displays on a casino gaming floor. The information may be displayed to the user on the mixed reality viewer in a number of different ways such as by displaying images on the mixed reality viewer that appear to be three dimensional or two-dimensional elements of the scene as viewed through the mixed reality viewer. In general, the type and/or amount of data that is displayed to the user may depend on what type of user is using the mixed reality viewer and, correspondingly, what level of permissions or access the user has. For example, a mixed reality viewer may be operated in one of a number of modes, such as a player mode, an observer mode or an operator mode. In a player mode, the mixed reality viewer may be used to display information about particular displays on a casino floor. The information may be generic information about a display or may be customized information about the displays based on the identity or preferences of the user of the mixed reality viewer. In an observer mode, the mixed reality viewer may be used to display information about particular displays on a casino floor or information about players of displays on the casino floor. In an operator mode, which is described in greater detail below, the mixed reality viewer may be used to display information about particular displays or other games on a casino floor or information about players of displays or other games on the casino floor, but the information may be different or more extensive than the information displayed to an observer or player.

Figure 4A:
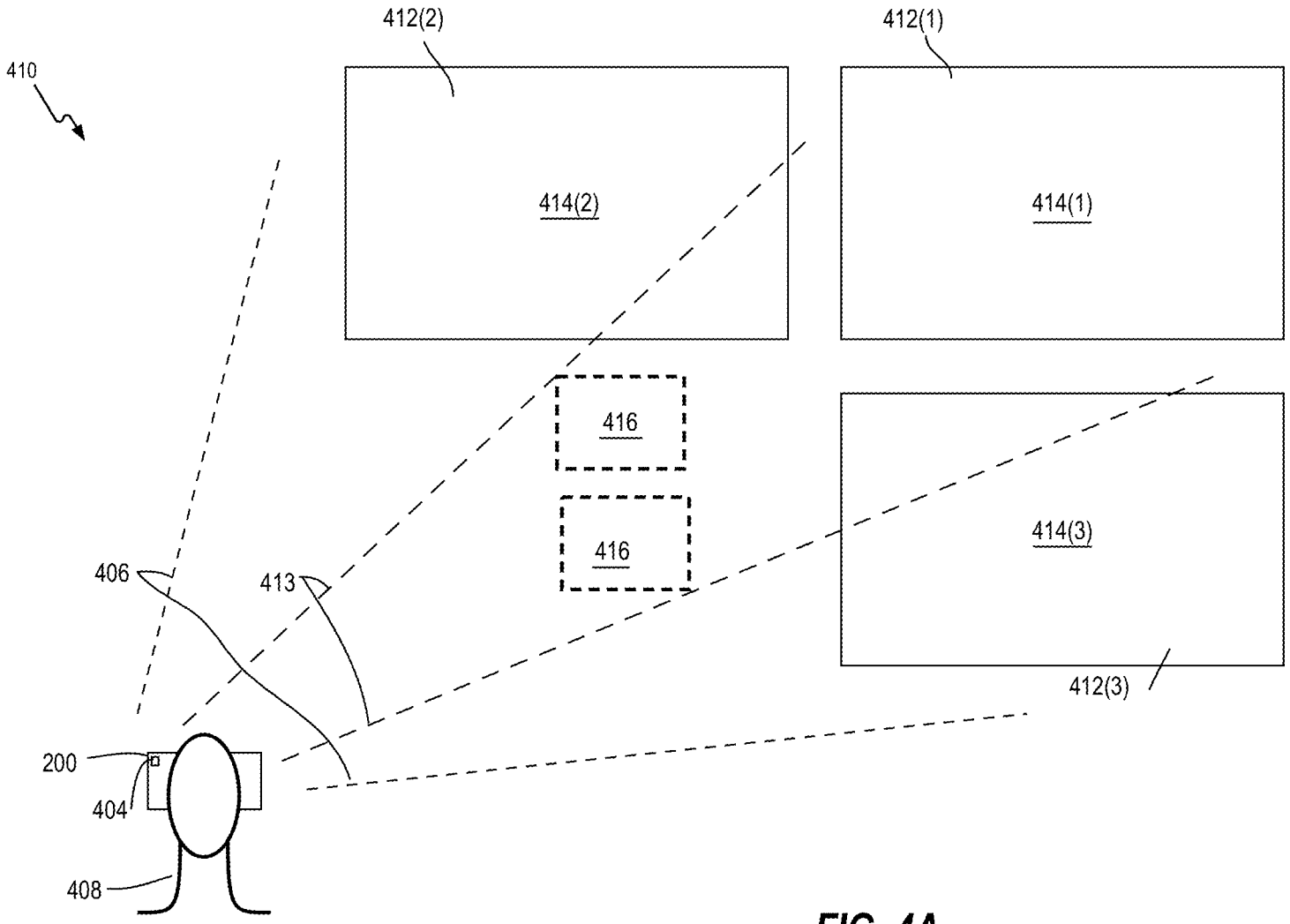
FIGS. 4A to 4C are views illustrating a user using a mixed reality viewer device to view a live sporting event in a casino environment, according to an embodiment.
Figure 4B:
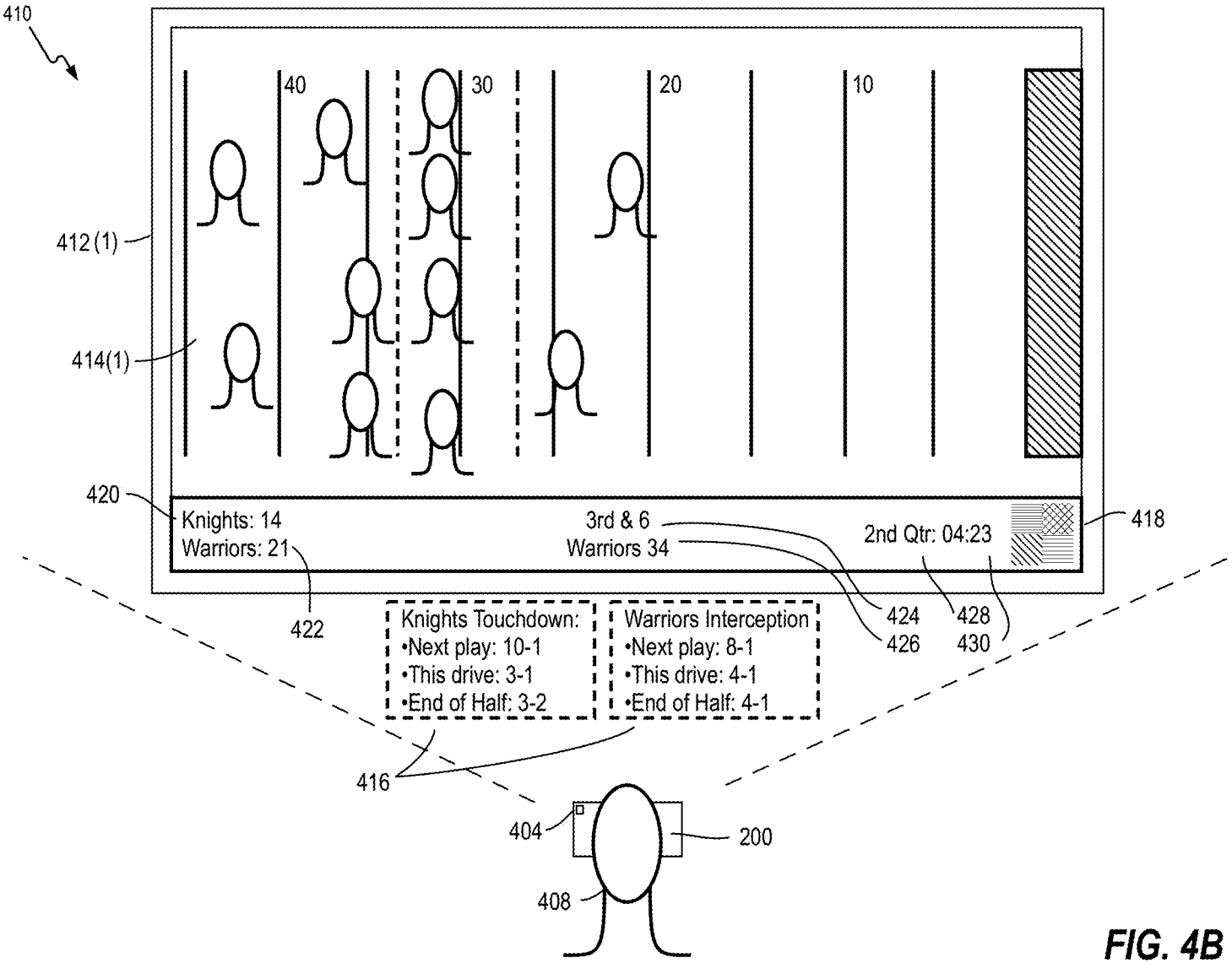
Figure 4C:
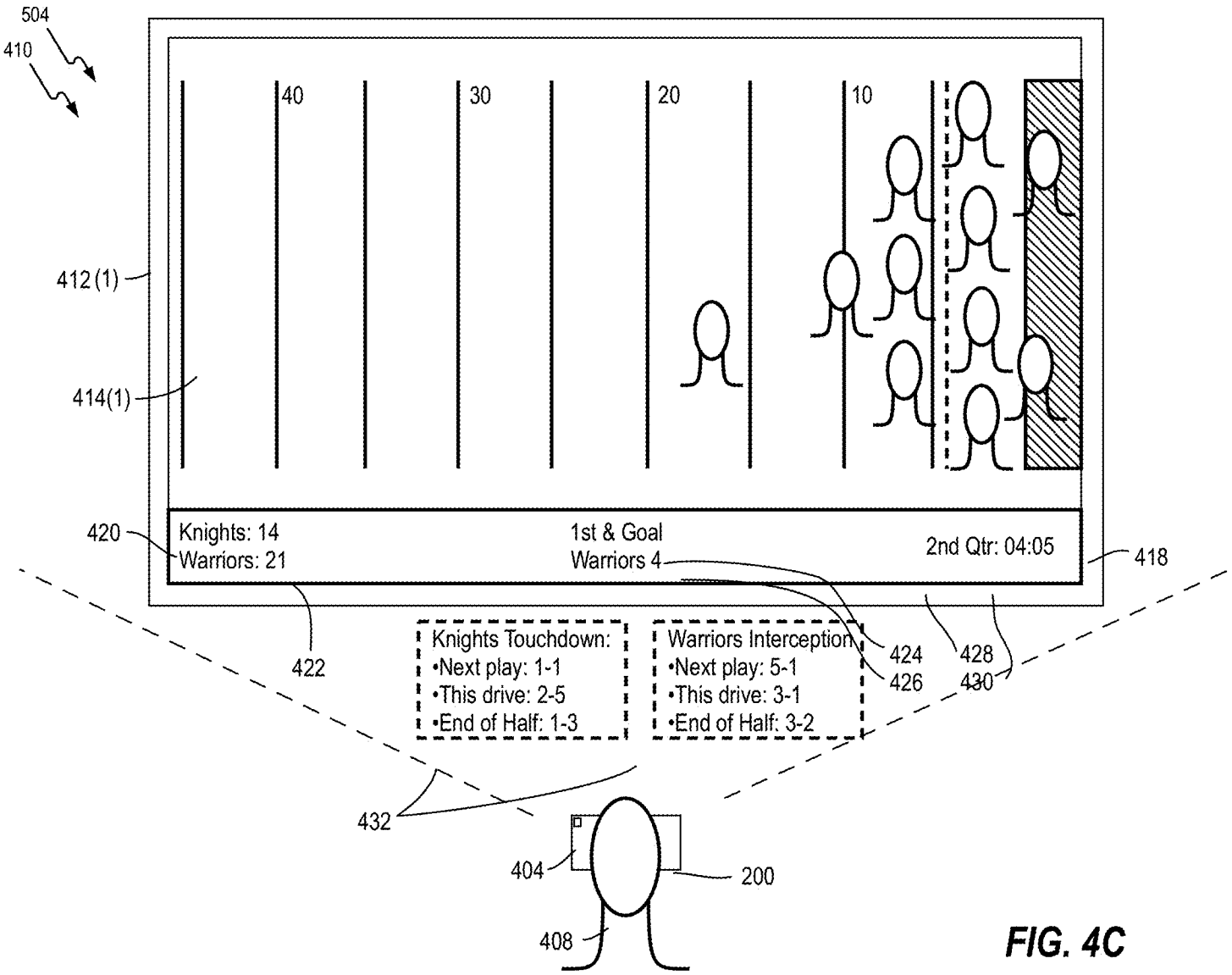

Referring now to FIGS. 4A-4C, views of a user viewing a sporting event 414 using a mixed reality viewer 200 to view additional information associated with the sporting event 400 are illustrated, according to an embodiment. In this embodiment, the mixed reality viewer 200 includes a head-wearable frame having an image capture device 404 (e.g., a camera) coupled thereto. The image capture device 404 in this embodiment is oriented so that a field of view 406 of the image capture device 404 corresponds to some or all of a field of view of a user 408 that is wearing the mixed reality viewer 200. In this example, the user 408 is in a casino sportsbook environment 410 having a plurality of display screens 412, which are displaying different sporting events and/or other information. As the user 408 moves his head, the image capture device 404 captures image data in the field of view 406 of the image capture device 404, which may include one or more of the display screens 412 displaying different live sporting events 414. In some embodiments, the mixed reality viewer 200 may be able to determine whether a viewing direction 413 for the user 408, e.g., to determine whether the user 408 is viewing or focusing on a particular display screen 412(1) of the plurality of display screens 412(1)-(3), such as through eye tracking, gaze detection, or other methods for example. Based on the image data, a particular live sporting event 414(1) being displayed on the particular display screen 412(1) is identified.

Based on identifying the live sporting event and determining a player status of the user 408, one or more wagers 416 associated with the particular live sporting event 414(1) are selected and displayed to the user 408 via the mixed reality viewer 200. The player status may be determined by retrieving player status data indicative of the player status of the user 408 from a player database, such as the player information database 95 of FIG. 1, for example. In some embodiments, the player status may include wager history information that indicates previous wagers placed by the user 408, and the wagers 416 may be selected based on the wager history information. Alternatively, or in addition, the player status may include player preference data that may be used to select the wagers 416 to be presented. In response to receiving acceptance data indicative of the user 408 accepting a particular wager 416, the wager 416 is then resolved. Resolving the wager 416 may include determining whether the wager was successful, i.e., indicates a win for the player, and may also include causing a prize, which may be a monetary or non-monetary prize, to be awarded to the user 408.

In some embodiments, selecting the wagers 416 may include determining a number of wagers of a particular wager type, such as a money-line bet or an over/under bet, for example, placed by the user 408 during a predetermined time period. If the number of bets of a particular type satisfies a predetermined threshold number, the wagers 416 may include, or be entirely composed of wagers of that particular type. In other embodiments, selecting the wagers 416 may include determining a monetary amount wagered by the player on wagers of the particular wager type. If the monetary amount satisfies the predetermined threshold amount, the wagers 416 may be selected from a subset of wagers that include, or are entirely composed of wagers of that particular type. The wagers 416 may also include similar wagers that can be bet in other sporting events that may be occurring at the same time, but that the player is not currently viewing. For example, on identifying the live sporting event and determining the player status, another wager of a plurality of wagers associated with another live sporting event may be provided. An indication of the wager may be provided to the display device and, in response to receiving acceptance data indicative of the player accepting the wager, the wager may be resolved. In some embodiments, the wager 416 may also, or alternatively, be selected based on player preference data that indicates predetermined wagering preferences for the player.

In some embodiments, some or all of the wagers 416 may be generated in real-time, near real-time, or at periodic intervals during the sporting events 414 based on events that occur during the sporting events 414. For example, a probability value for a future event to occur in the live sporting event may be generated based on event data indicative of a plurality of past events associated with the live sporting event 414. Referring now to FIG. 4B, a wager 416 may be generated that includes an award value, based on the probability value, that will be awarded if the future event occurs in the live sporting event 414. Alternatively, a predetermined wager having a predetermined award value that will be awarded if the future event occurs in the live sporting event may be determined. In this example, generating the wager may include modifying the predetermined wager to replace the predetermined award value with the award value based on the probability value. In another alternative example, a predetermined wager having a predetermined award value equal to the award value that will be awarded if a different predetermined future event occurs in the live sporting event. In this example, generating the wager may include modifying the predetermined wager to replace the predetermined future event with the future event so that the wager includes the award value that will be awarded if the future event occurs in the live sporting event. In some examples, in addition to providing the wager 416 to the user 408, the mixed reality viewer 200 may also provide a message indicative of a relationship between the plurality of past events and the wager 416 to the user 408.

In these and other embodiments, the live sporting event 414 may be identified based on the image data in a number of ways. For example, the image data may include a watermark, such as a visual watermark 418 that is part of the image of the live sporting event 414 being displayed on the display screen 412. Alternatively, the watermark may be a visual watermark that is separate from a particular display screen 412, or may be visible only in a wavelength band that is detectable by the image capture device but not by a human eye, e.g., as an infrared or ultraviolet image. In some examples, the watermark 418 may be visible to all viewers and may be used to register the mixed reality device 200 or other device with a server, such as the central controller 40 or the mixed reality controller 70 of FIG. 1, for example.

In another embodiment, the image data captured by the camera 404 may be used to determine aspects of the sporting event 414(1), such as the teams 420, a current score 422, a current play 424, a field position 426, a current period 428, time remaining 430, and/or any other aspect of the sporting event that can be derived from the image data. It should also be understood that alternative operations for identifying aspects of the live sporting event 414(1) may be employed as well, such as a data transmission that may be transmitted to the mixed reality viewer 200 by radio frequency, infrared, ultrasonic, or other protocols.

In some embodiments, the live sporting event 414 may be identified based on the image data by correlating the watermark 418 in the image with an event identifier indicative of the live sporting event 414. The wager 416 may then be selected from a subset of wagers associated with the event identifier.

As shown by FIGS. 4B and 4C, the available wagers 416 can be updated in real time, in near real time, or periodically as the sporting event 414 proceeds. For example, a particular wager 416 of FIG. 4A may be based on calculated odds of an event occurring during the live sporting event 414(1), e.g., for a particular football team to score a touchdown on the next play, in the current drive, in the current half, etc. As the sporting event progresses, the odds of the event occurring may increase or decrease, and the wagers 416 may be updated based on an updated calculation of the odds of the event occurring. As shown by FIG. 4C, an updated wager(s) 432 may replace the original wager(s) 416 to reflect the new odds based on progression of the sporting event 414.

These and other embodiments have the additional advantage of educating users with additional information regarding a sporting event and/or the participants therein, which may increase the interest and excitement of users, and may lead to greater engagement and involvement in wagering on the sporting event. Another advantage of these and other embodiments is that, by providing dynamic wagers that may be updated in real time or near real time and/or that may be resolved in response to short term events, an experienced player's edge in selecting sport bets may be reduced, and the operator's expected revenue may increase. Thus, these and other embodiments provide a unique technical solution to the technical problem of providing additional wagers to a player for a live sporting event in a way that keeps the player engaged. For example, with traditional wagering, a player may make one bet during the entire game. These and other embodiments enable a player to remain engaged throughout the game through the ability to make multiple wagers.

Figure 5:
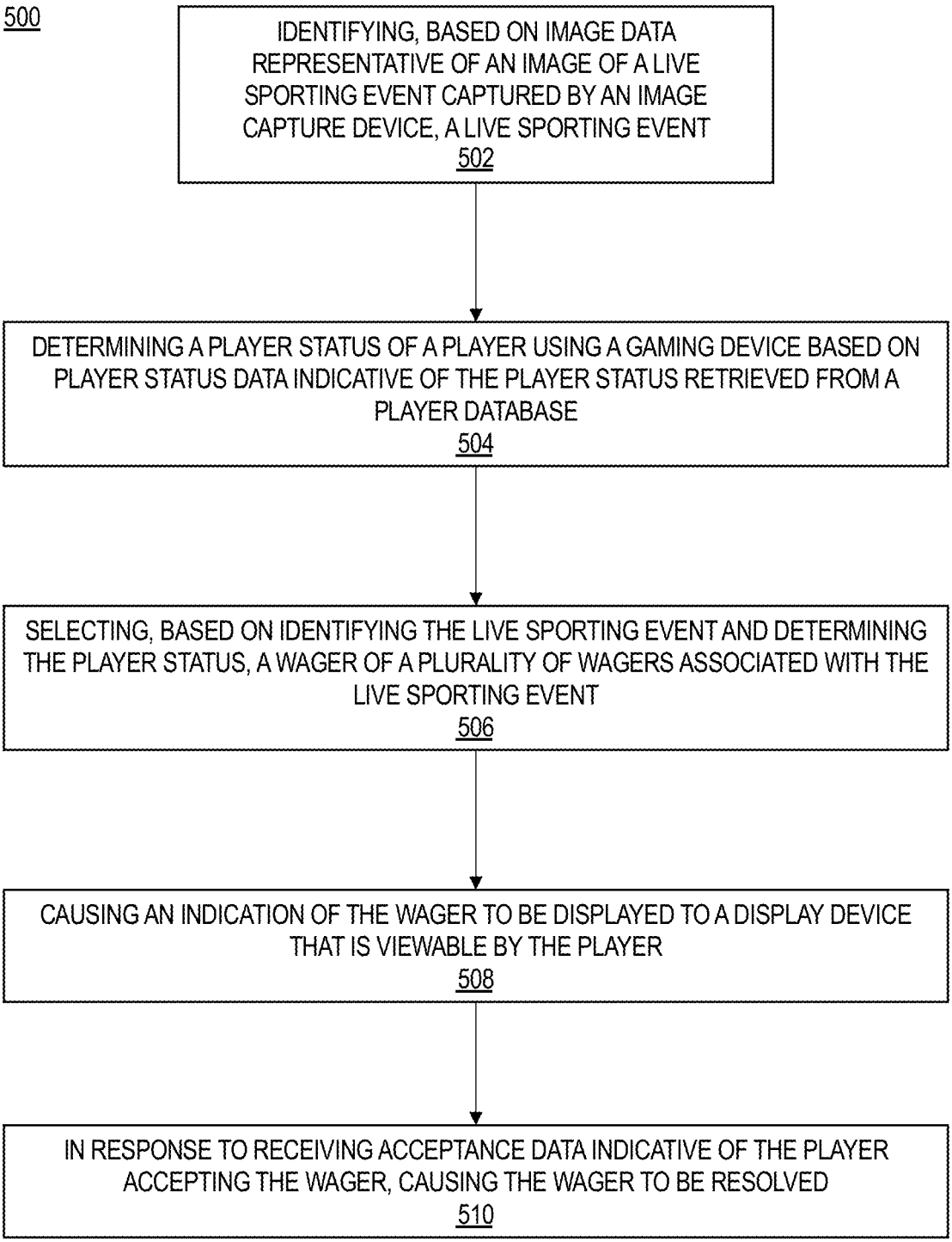
FIG. 5 is a flowchart diagram of operations for using a mixed reality viewer device to providing mixed reality sporting event wagering, according to an embodiment.

These and other examples may be implemented through one or more computer-implemented methods. In this regard, FIG. 5 is a flowchart diagram of operations 500 for using a mixed reality viewer device to providing mixed reality sporting event wagering, according to an embodiment. In this embodiment, the operations 500 may include identifying, based on image data representative of an image of a live sporting event captured by an image capture device, the live sporting event (Block 502). The operations 500 may further include determining a player status of a player using a gaming device based on player status data indicative of the player status retrieved from a player database (Block 504). The operations 500 may further include selecting, based on identifying the live sporting event and determining the player status, a wager of a plurality of wagers associated with the live sporting event (Block 506). The operations 500 may further include causing an indication of the wager to be displayed to a display device that is viewable by the player (Block 508). The operations 500 may further include, in response to receiving acceptance data indicative of the player accepting the wager, causing the wager to be resolved (Block 510).

Figure 6:
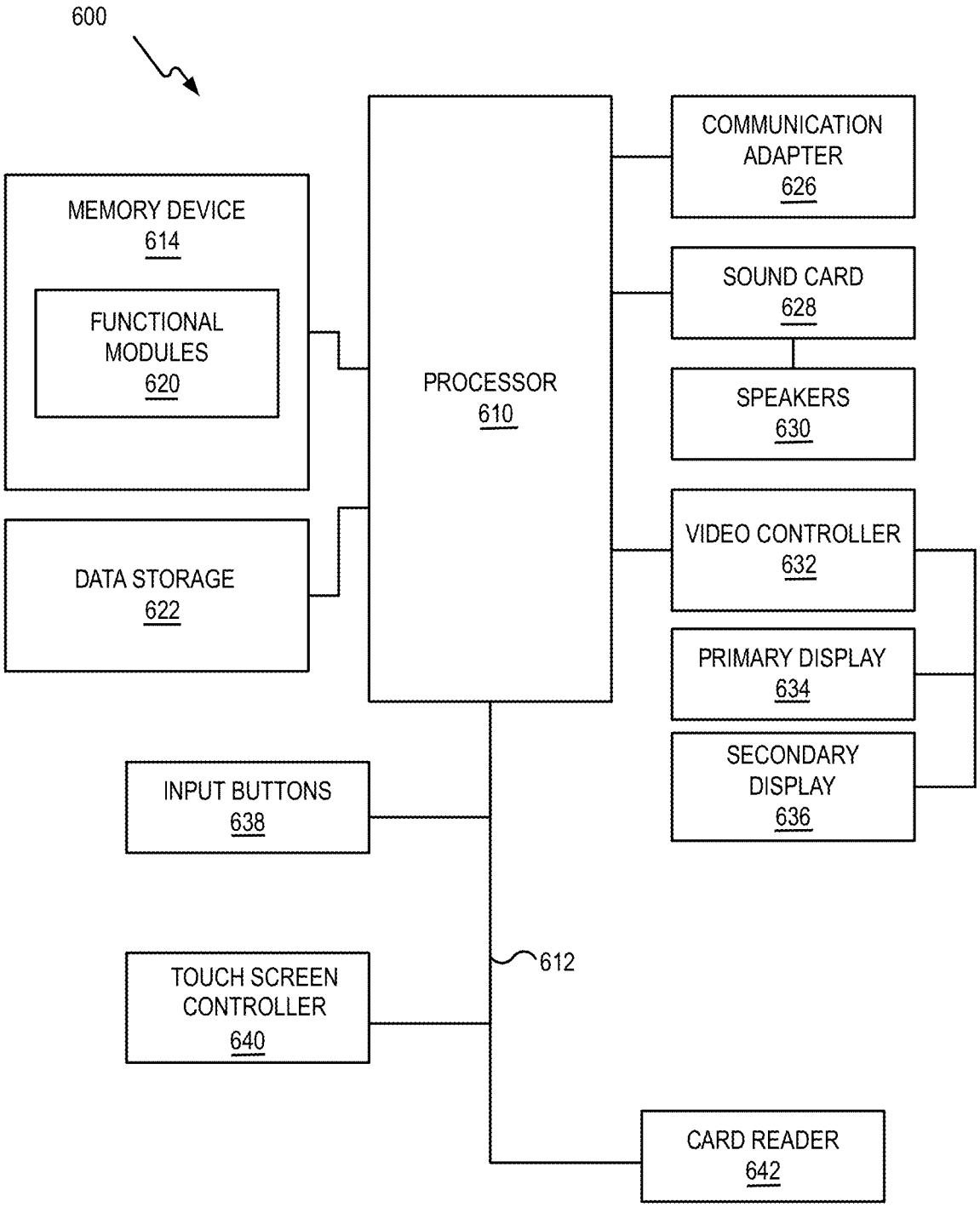
FIG. 6 is a block diagram that illustrates various components of a mixed reality viewer device and/or other associated computing devices according to some embodiments.

Referring now to FIG. 6, a block diagram that illustrates various components of a computing device 600, which may embody or be included as part of the mixed reality viewer 200, discussed above, according to some embodiments. As shown in FIG. 6, the computing device 600 may include a processor circuit 610 that controls operations of the computing device 600. Although illustrated as a single processor, multiple special purpose and/or general-purpose processors and/or processor cores may be provided in the computing device 600. For example, the computing device 600 may include one or more of a video processor, a signal processor, a sound processor and/or a communication controller that performs one or more control functions within the computing device 600. The processor circuit 610 may be variously referred to as a "controller," "microcontroller," "microprocessor" or simply a "computer." The processor circuit 610 may further include one or more application-specific integrated circuits (ASICs).

Various components of the computing device 600 are illustrated in FIG. 9 as being connected to the processor circuit 610. It will be appreciated that the components may be connected to the processor circuit 610 and/or each other through one or more busses 612 including a system bus, a communication bus and controller, such as a USB controller and USB bus, a network interface, or any other suitable type of connection.

The computing device 600 further includes a memory device 614 that stores one or more functional modules 620 for performing the operations described above. Alternatively, or in addition, some of the operations described above may be performed by other devices connected to the network, such as the network 50 of the system 10 of FIG. 1, for example. The computing device 600 may communicate with other devices connected to the network to facilitate performance of some of these operations. For example, the computing device 600 may communicate and coordinate with certain displays to identify elements of a race being displayed by a particular display.

The memory device 614 may store program code and instructions, executable by the processor circuit 610, to control the computing device 600. The memory device 614 may include random access memory (RAM), which can include non-volatile RAM (NVRAM), magnetic RAM (ARAM), ferroelectric RAM (FeRAM) and other forms as commonly understood in the gaming industry. In some embodiments, the memory device 614 may include read only memory (ROM). In some embodiments, the memory device 614 may include flash memory and/or EEPROM (electrically erasable programmable read only memory). Any other suitable magnetic, optical and/or semiconductor memory may operate in conjunction with the gaming device disclosed herein.

The computing device 600 may include a communication adapter 626 that enables the computing device 600 to communicate with remote devices, such as the wireless network, another computing device 600, and/or a wireless access point, over a wired and/or wireless communication network, such as a local area network (LAN), wide area network (WAN), cellular communication network, or other data communication network, e.g., the network 50 of FIG. 1.

The computing device 600 may include one or more internal or external communication ports that enable the processor circuit 610 to communicate with and to operate with internal or external peripheral devices, such as a sound card 628 and speakers 630, video controllers 632, a primary display 634, a secondary display 636, input buttons 638 or other devices such as switches, keyboards, pointer devices, and/or keypads, a touch screen controller 640, a card reader 642, currency acceptors and/or dispensers, cameras, sensors such as motion sensors, mass storage devices, microphones, haptic feedback devices, and/or wireless communication devices. In some embodiments, internal or external peripheral devices may communicate with the processor through a universal serial bus (USB) hub (not shown) connected to the processor circuit 610. Although illustrated as being integrated with the computing device 600, any of the components therein may be external to the computing device 600 and may be communicatively coupled thereto. Although not illustrated, the computing device 600 may further include a rechargeable and/or replaceable power device and/or power connection to a main power supply, such as a building power supply.

In some embodiments, the computing device 600 may include a head mounted device (HMD) and may include optional wearable add-ons that include one or more sensors and/or actuators. Including ones of those discussed herein. The computing device 600 may be a head-mounted mixed-reality device configured to provide mixed reality elements as part of a real-world scene being viewed by the user wearing the computing device 600.

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C #, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations and/or block diagrams of methods, apparatuses (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks. The flowchart and block diagrams in the figures illustrate the architecture, functionality, and operation of possible implementations of systems, methods, and computer program products according to various aspects of the present disclosure. In this regard, each block in the flowchart or block diagrams may represent a module, segment, or portion of code, which includes one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be designated as "/". Like reference numbers signify like elements throughout the description of the figures.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

What is claimed is:

1. A gaming system comprising:

a processor circuit; and a memory coupled to the processor circuit, the memory comprising machine-readable instructions that, when executed by the processor circuit, cause the processor circuit to:

cause an image capture device to capture image data representative of an image of a live sporting event;

identify the live sporting event based on the image data;

retrieve, from a player database, player status data indicative of a player status of a player using a gaming device;

determine the player status of the player based on the player status data;

select, based on identifying the live sporting event and determining the player status, a wager of a plurality of wagers associated with the live sporting event;

provide an indication of the wager to a display device that is viewable by the player; and in response to receiving acceptance data indicative of the player accepting the wager, resolve the wager.

2. The gaming system of claim 1, wherein the player status comprises wager history information that indicates previous wagers placed by the player, and wherein the machine-readable instructions further cause the processor circuit to select the wager further based on the wager history information.

3. The gaming system of claim 2, wherein the machine-readable instructions further cause the processor circuit to:

determine a number of wagers comprising a first wager type of a plurality of wager types placed by the player during a predetermined time period;

determine whether the number of wagers satisfies a predetermined threshold number; and in response to determining that the number of wagers satisfies the predetermined threshold number, select the wager from a subset of the plurality of wagers, wherein each wager of the subset of the plurality of wagers comprises the first wager type.

4. The gaming system of claim 2, wherein the machine-readable instructions further cause the processor circuit to:

determine a monetary amount wagered by the player on wagers comprising a first wager type of a plurality of wager types during a predetermined time period;

determine whether the monetary amount satisfies a predetermined threshold amount; and in response to determining that the monetary amount satisfies the predetermined threshold amount, select the wager from a subset of the plurality of wagers, wherein each wager of the subset of the plurality of wagers comprises the first wager type.

5. The gaming system of claim 1, wherein the player status comprises player preference data that indicates predetermined wagering preferences for the player, and wherein the machine-readable instructions further cause the processor circuit to select the wager further based on the player preference data.

6. The gaming system of claim 1, wherein the machine-readable instructions further cause the processor circuit to:

generate, based on event data indicative of a plurality of past events associated with the live sporting event, a probability value for a future event to occur in the live sporting event; and generate the wager, wherein the wager comprises an award value that will be awarded if the future event occurs in the live sporting event, wherein the award value is based on the probability value.

7. The gaming system of claim 6, wherein the machine-readable instructions further cause the processor circuit to:

determine a predetermined wager of the plurality of wagers comprising a predetermined award value that will be awarded if the future event occurs in the live sporting event, wherein generating the wager further comprises modifying the predetermined wager to replace the predetermined award value with the award value based on the probability value.

8. The gaming system of claim 6, wherein the machine-readable instructions further cause the processor circuit to:

determine a predetermined wager of the plurality of wagers comprising a predetermined award value that will be awarded if a predetermined future event occurs in the live sporting event, wherein the predetermined award value is equal to the award value, wherein generating the wager further comprises modifying the predetermined wager to replace the predetermined future event with the future event so that the wager comprises the award value that will be awarded if the future event occurs in the live sporting event.

9. The gaming system of claim 6, wherein the machine-readable instructions further cause the processor circuit to:

provide, in association with providing the indication of the wager to the display device, a message indicative of a relationship between the plurality of past events and the wager to the display device.

10. The gaming system of claim 1, wherein the machine-readable instructions further cause the processor circuit to:

detect a watermark in the image data, wherein identifying the live sporting event based on the image data further comprises correlating the watermark in the image with an event identifier indicative of the live sporting event, and wherein selecting the wager further comprises selecting the wager from a subset of wagers associated with the event identifier.

11. A computer-implemented method comprising:

based on image data representative of an image of a live sporting event captured by an image capture device, identifying the live sporting event;

determining a player status of a player using a gaming device based on player status data indicative of the player status retrieved from a player database;

selecting, based on identifying the live sporting event and determining the player status, a wager of a plurality of wagers associated with the live sporting event;

causing an indication of the wager to be displayed to a display device that is viewable by the player; and in response to receiving acceptance data indicative of the player accepting the wager, causing the wager to be resolved.

12. The computer-implemented method of claim 11, wherein the player status comprises wager history information that indicates previous wagers placed by the player, the method further comprising:

selecting the wager further based on the wager history information.

13. The computer-implemented method of claim 12, further comprising:

determining a number of wagers comprising a first wager type of a plurality of wager types placed by the player during a predetermined time period;

determining whether the number of wagers satisfies a predetermined threshold number; and in response to determining that the number of wagers satisfies the predetermined threshold number, selecting the wager from a subset of the plurality of wagers, wherein each wager of the subset of the plurality of wagers comprises the first wager type.

14. The computer-implemented method of claim 12, further comprising:

determining a monetary amount wagered by the player on wagers comprising a first wager type of a plurality of wager types during a predetermined time period;

determining whether the monetary amount satisfies a predetermined threshold amount; and in response to determining that the monetary amount satisfies the predetermined threshold amount, selecting the wager from a subset of the plurality of wagers, wherein each wager of the subset of the plurality of wagers comprises the first wager type.

15. The computer-implemented method of claim 11, wherein the player status comprises player preference information that indicates predetermined wagering preferences for the player, and wherein selecting the wager is further based on the player preference information.

16. The computer-implemented method of claim 11, further comprising:

generating, based on event data indicative of a plurality of past events associated with the live sporting event, a probability value for a future event to occur in the live sporting event; and generating the wager, wherein the wager comprises an award value that will be awarded in response to the future event occurring in the live sporting event, wherein the award value is based on the probability value.

17. The computer-implemented method of claim 16, further comprising:

determining a predetermined wager of the plurality of wagers comprising a predetermined award value that will be awarded in response to the future event occurring in the live sporting event, wherein generating the wager further comprises modifying the predetermined wager to replace the predetermined award value with the award value based on the probability value.

18. A gaming device comprising:

an image capture device;

a display device;

an input device;

a processor circuit; and a memory coupled to the processor circuit, the memory comprising machine-readable instructions that, when executed by the processor circuit, cause the processor circuit to:

cause the image capture device to capture image data representative of an image of a live sporting event;

identify the live sporting event based on the image data;

retrieve player status data indicative of a player status of a player using the gaming device from a player database;

determine the player status of the player based on the player status data;

select, based on identifying the live sporting event and determining the player status, a wager of a plurality of wagers associated with the live sporting event;

provide an indication of the wager to the display device; and in response to receiving acceptance data from the input device indicative of the player accepting the wager, transmit an instruction to resolve the wager to a gaming server.

19. The gaming device of claim 18, wherein the player status comprises wager history information that indicates previous wagers placed by the player, and wherein the machine-readable instructions further cause the processor circuit to select the wager further based on the wager history information.

20. The gaming device of claim 18, wherein the machine-readable instructions further cause the processor circuit to:

generate, based on event data indicative of a plurality of past events associated with the live sporting event, a probability value for a future event to occur in the live sporting event; and generate the wager, wherein the wager comprises an award value that will be awarded in response to the future event occurring in the live sporting event, wherein the award value is based on the probability value.

* * * * *